US006896360B2

(12) United States Patent
Cox et al.

(10) Patent No.: US 6,896,360 B2
(45) Date of Patent: May 24, 2005

(54) BARRIER FEATURE IN FLUID CHANNEL

(75) Inventors: Julie Jo Cox, Albany, OR (US); Jeremy H Donaldson, Corvallis, OR (US); Jules G. Moritz, III, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/285,254

(22) Filed: Oct. 31, 2002

(65) Prior Publication Data

US 2004/0085407 A1 May 6, 2004

(51) Int. Cl.[7] ..... B41J 2/05
(52) U.S. Cl. ..... 347/65; 347/56; 347/54
(58) Field of Search ..... 347/20, 63, 45, 347/47, 94, 92, 54, 56, 65, 85

(56) References Cited

U.S. PATENT DOCUMENTS

| | | | | |
|---|---|---|---|---|
| 4,882,595 A | | 11/1989 | Trueba et al. | 347/85 |
| 4,897,674 A | * | 1/1990 | Hirasawa | 347/65 |
| 5,412,413 A | * | 5/1995 | Sekiya et al. | 347/65 |
| 5,463,413 A | * | 10/1995 | Ho et al. | 347/65 |
| 5,988,786 A | | 11/1999 | Waller et al. | 347/20 |
| 6,158,843 A | | 12/2000 | Murthy et al. | 347/47 |
| 6,231,168 B1 | | 5/2001 | Maze et al. | 347/65 |
| 6,309,054 B1 | | 10/2001 | Kawamura et al. | 347/65 |
| 6,364,467 B1 | | 4/2002 | Blair et al. | 347/65 |
| 6,409,318 B1 | | 6/2002 | Clark | 347/65 |
| 6,439,692 B1 | * | 8/2002 | Misumi | 347/54 |
| 6,682,177 B2 | * | 1/2004 | Hsu et al. | 347/63 |

FOREIGN PATENT DOCUMENTS

| | | | |
|---|---|---|---|
| EP | 0314486 A2 * | 5/1989 | |
| EP | 0842776 A2 | 5/1998 | B41J/2/05 |
| EP | 0921001 A1 | 6/1999 | B41J/2/14 |

OTHER PUBLICATIONS

U.S. Appl. No. 10/003,175 filed Oct. 31, 2001 by Coventry et al. entitled Ink Jet Printhead Having Thin Film Structures For Improving Barrier Island Adhesion.
U.S. Appl. No. 10/057,528 filed Jan. 25, 2002 by Dustin W. Blair entitled Feed Channels Of A Fluid Ejection Device.

* cited by examiner

*Primary Examiner*—Hai Pham
*Assistant Examiner*—Lam S Nguyen

(57) ABSTRACT

A fluid ejection device comprising a substrate having a first surface, and a fluid ejector formed over the first surface. A top layer is also formed over the first surface of the substrate and defines a chamber about the fluid ejector. The top layer also defines a fluid channel that directs fluid into the chamber. In one embodiment, a barrier feature is positioned within the fluid channel, and has a height that is less than the height of the fluid channel.

27 Claims, 9 Drawing Sheets

SECTION

BARRIER FEATURE IN FLUID CHANNEL

FIELD OF THE INVENTION

The present invention relates to fluid ejection devices, and more particularly to a barrier feature in a fluid channel of a fluid ejection device.

BACKGROUND OF THE INVENTION

Various inkjet printing arrangements include both thermally actuated printheads and mechanically actuated printheads. Thermal actuated printheads tend to use resistive elements or the like to achieve ink expulsion, while mechanically actuated printheads tend to use piezoelectric transducers or the like.

A representative thermal inkjet printhead has a plurality of thin film resistors provided on a semiconductor substrate. A barrier layer is deposited over thin film layers on the substrate. The barrier layer defines firing chambers about each of the resistors, an orifice corresponding to each firing chamber, and an entrance or fluid channel to each firing chamber. Often, ink is provided through a slot in the substrate and flows through the fluid channel to the firing chamber. Actuation of a heater resistor by a "fire signal" causes ink in the corresponding firing chamber to be heated and expelled through the corresponding orifice.

In some instances, bubbles or particles can occlude fluid flow through the fluid slot, through the fluid channel, or within the firing chamber. Print quality and resistor life may be affected by the fluid occlusion. Accordingly, there is a desire to maximize tolerance to bubbles and/or particles within the fluid ejection device.

SUMMARY

A fluid ejection device comprising a substrate having a first surface, and a fluid ejector formed over the first surface. A top layer is formed over the first surface of the substrate and defines a chamber about the fluid ejector. The top layer defines a fluid channel that directs fluid into the chamber. In one embodiment, a barrier feature is positioned within the fluid channel, and has a height that is less than the height of the fluid channel.

DETAILED DESCRIPTION

Overview of a Fluid Ejection Device Embodiment

Figure 1:
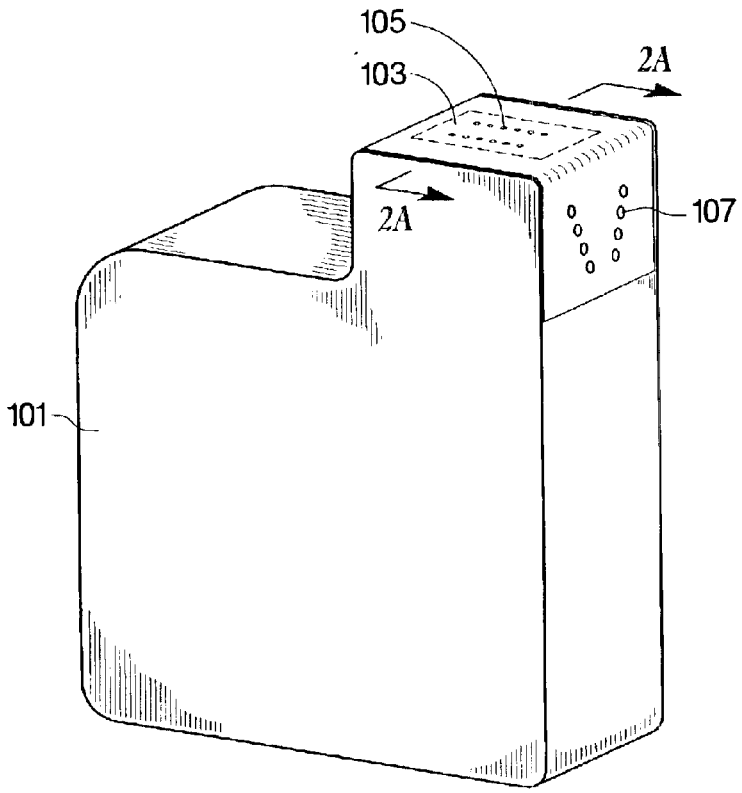
FIG. 1 illustrates a perspective view of an embodiment of a fluid ejection cartridge of the present invention.

FIG. 1 is a perspective view of an embodiment of a cartridge 101 having a fluid ejection device 103, such as a printhead. The cartridge houses a fluid supply, such as ink. In this embodiment, visible at the outer surface of the printhead are a plurality of orifices or nozzles 105 through which fluid is selectively expelled. In one embodiment, the fluid is expelled upon commands of a printer (not shown), which commands are communicated to the printhead through electrical connections 107.

Figure 2A:
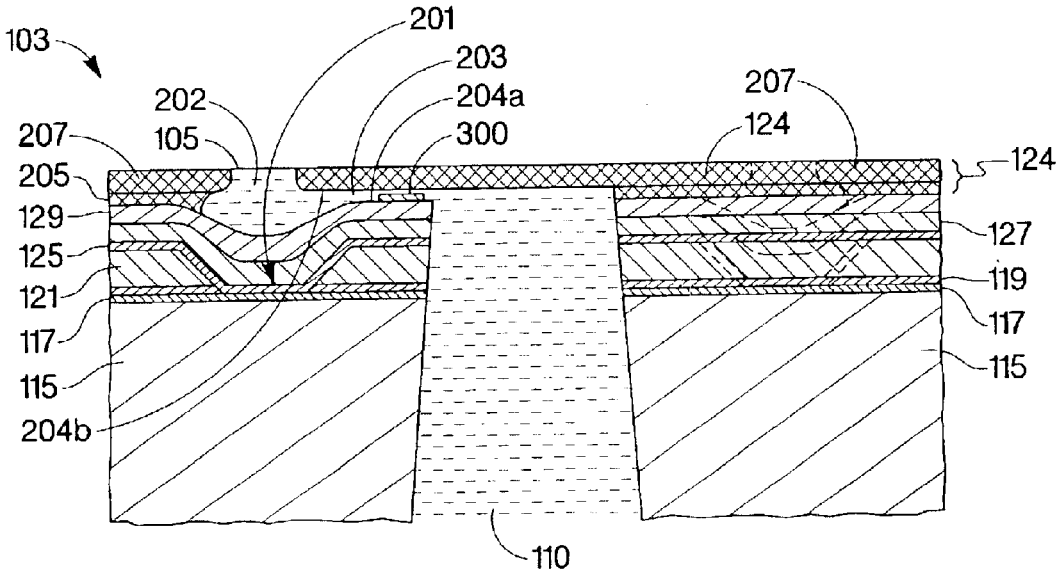
FIG. 2A illustrates a cross-sectional view of an embodiment of a fluid ejection device taken through section 2A—2A of FIG. 1.

The embodiment of FIG. 2A illustrates a cross-sectional view of the printhead 103 of FIG. 1 where a slot 110 is formed through a substrate 115. Some of the embodiments used in forming the slot through a slot region (or slot area) in the substrate include abrasive sand blasting, wet etching, dry etching, DRIE, and UV laser machining.

In one embodiment, the substrate 115 is silicon. In various embodiments, the substrate is one of the following: single crystalline silicon, polycrystalline silicon, gallium arsenide, glass, silica, ceramics, or a semiconducting material. The various materials listed as possible substrate materials are not necessarily interchangeable and are selected depending upon the application for which they are to be used.

In the embodiment of FIG. 2A, a thin film stack (such as an active layer, an electrically conductive layer, or a layer with micro-electronics) is formed or deposited on a front or first side (or surface) of the substrate 115. The thin film stack can include, in one embodiment, a capping layer 117 formed over a first surface of the substrate. Capping layer 117 may be formed of a variety of different materials such as field oxide, silicon dioxide, aluminum oxide, silicon carbide, silicon nitride, and glass (PSG). In this embodiment, a layer 119 is deposited or grown over the capping layer 117. In a particular embodiment, the layer 119 is at least one of titanium nitride, titanium tungsten, titanium, a titanium alloy, a metal nitride, tantalum aluminum, and aluminum silicone.

The thin film stack can include, in this embodiment, a conductive layer 121 formed by depositing conductive material over the layer 119. The conductive material is formed of at least one of a variety of different materials including aluminum, aluminum with about ½% copper, copper, gold, and aluminum with ½% silicon, and may be deposited by any method, such as sputtering and evaporation. The conductive layer 121 is patterned and etched to form conductive traces. After forming the conductor traces, a resistive material 125 is deposited over the etched conductive material 121. The resistive material is etched to form an ejection element 201, such as a fluid ejector, a resistor, a heating element, or a bubble generator. A variety of suitable resistive materials are known to those of skill in the art including tantalum aluminum, nickel chromium, tungsten silicon nitride, and titanium nitride, which may optionally be doped with suitable impurities such as oxygen, nitrogen, and carbon, to adjust the resistivity of the material.

The thin film stack can also include, as shown in the embodiment of FIG. 2A, an insulating passivation layer 127 formed over the resistive material. Passivation layer 127 may be formed of any suitable material such as silicon dioxide, aluminum oxide, silicon carbide, silicon nitride, and glass. In this embodiment, a cavitation layer 129 is added over the passivation layer 127. In a particular embodiment, the cavitation layer is at least one of Ta, SiC, or TiN.

In one embodiment, a top layer 124 is deposited over the cavitation layer 129. In one embodiment, the top layer 124 is a layer comprised of a fast cross-linking polymer such as photoimagable epoxy (such as SU8 developed by IBM), photoimagable polymer or photosensitive silicone dielectrics, such as SINR-3010 manufactured by ShinEtsu™. In another embodiment, the top layer 124 is made of a blend of organic polymers which is substantially inert to the corrosive action of ink. Polymers suitable for this purpose include products sold under the trademarks VACREL and RISTON by E. I. DuPont de Nemours and Co. of Wilmington, Del.

An example of a printhead is illustrated at page 44 of the Hewlett-Packard Journal of February 1994. Further examples of printheads are set forth in commonly assigned U.S. Pat. No. 4,719,477, U.S. Pat. No. 5,317,346, and U.S. Pat. No. 6,162,589. Embodiments of the present invention include having any number and type of layers formed or deposited over the substrate, depending upon the application.

In a particular embodiment, the top layer 124 defines a firing chamber 202 where fluid is heated by the corresponding ejection element 201 and defines a nozzle orifice 105 through which the heated fluid is ejected. Fluid flows through the slot 110 and into the firing chamber 202 via channels 203 defined by the top layer 124. Flow of a current or a "fire signal" through the resistor causes fluid in the corresponding firing chamber to be heated and expelled through the corresponding nozzle 105. In another embodiment, an orifice layer defining the orifices 105 is formed over the top layer 124.

In the embodiment illustrated in FIG. 2A, the top layer 124 includes two layers 205, 207. The first layer, such as a primer or bottom layer, 205 is formed over layer 129, and the second layer, such as a top chamber layer, 207 is formed over layer 205. In one embodiment, layers 205 and 207 are formed of different materials. In this embodiment, layers 205 and 207 are formed of the same material. In alternative embodiments, the layers 205 and 207 are about the same thickness, or layer 207 is thicker than layer 205, or layer 205 is thicker than layer 207. In this embodiment, layer 205 is thinner than layer 207.

In this embodiment shown, the fluid channel 203 has a height defined from a floor or bottom 204*a* of layer 124, to a ceiling (or top surface) 204*b* of the fluid channel. The fluid channel height is in a range of about 20 to 30 microns. The fluid channel 203 has a width defined from one side wall 204*c* of the fluid channel to an opposite side wall 204*c* of the fluid channel. In embodiments where the channel tapers either away from or toward the chamber, the width varies therealong. The fluid channel width is in a range of about 15 to 40 microns. The fluid channel length is in a range of about 20 to 80 microns. In another embodiment, these fluid channel dimensions are scaled down in size for femtoliter size drops, rather than picoliter size drops.

In this embodiment, within the fluid channel 203 is a barrier feature 300. In another embodiment, the barrier feature is one of a barrier island, a short platform, and a stalagmite. In yet another embodiment, the barrier feature acts as a bubble direction disruptor. In the embodiment shown in FIG. 2A, the barrier feature 300 has a height that is less than a height of the fluid channel.

In one embodiment, the barrier feature is formed of the same material as the top layer 124. In one embodiment, the barrier feature 300 on the floor 204*a* of the fluid channel is formed with the first layer 205 in the same process as described herein. In this embodiment, the barrier feature 300 has the same height as the first layer 205. In this embodiment, the first layer 205 at least partially defines the firing chamber 202 and fluid channel, and the second layer 207 defines the ceiling 204*b* of the fluid channel, the remainder of the firing chamber 202, as well as the nozzle 105.

In another embodiment, the barrier feature 300 is formed of a different material than the top layer 124. For instance, the barrier feature 300 may be formed of any material that is capable of being planarized using Chemical-Mechanical Polishing (CMP). For example, other polymers, an oxide and a nitride are alternative materials used in forming the barrier feature of similar heights. However, alternative deposition methods may be used in depositing these alternative materials.

Figure 2B:
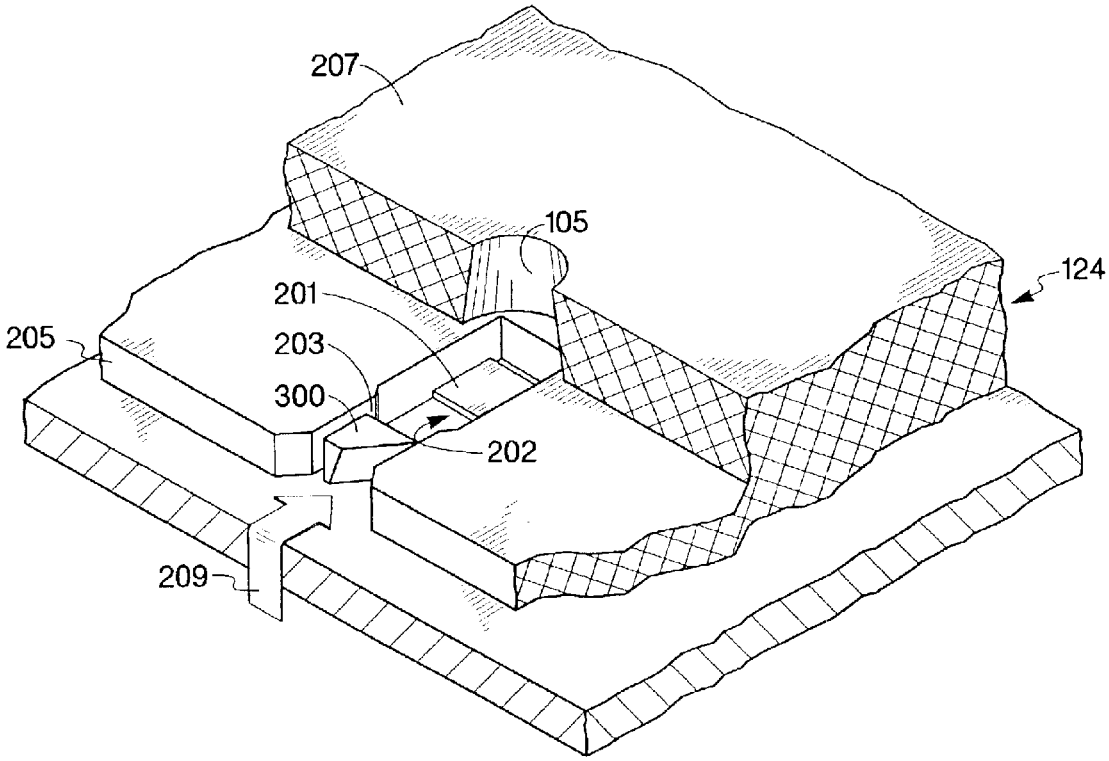
FIG. 2B is a perspective view of an embodiment of a barrier feature and a corresponding firing chamber.

FIG. 2B illustrates a perspective view of the barrier feature 300 within the fluid channel 203. In this embodiment, fluid 209 flows from a fluid feed edge of a fluid supply (not shown) through the fluid channel 203, around and over the barrier feature 300 and into the firing chamber 202. In this embodiment shown, the barrier feature does not extend beyond the edge of the top layer 124 (or primer layer 205). In particular, the barrier feature is surrounded on at least three (3) sides by the side walls 204*c* of the fluid channel and the firing chamber, in this embodiment. In a more particular embodiment, the barrier feature is not in the shelf region, i.e. not in between a fluid feed edge and the top layer.

Barrier Feature Embodiments

Various embodiments of the barrier feature(s) in the fluid channel 203 are shown in the following figures. In the plan view of these embodiments, the nozzle layer (207, 208) above the fluid channel is not illustrated for ease of viewing of these particular barrier feature(s).

Figure 3A:
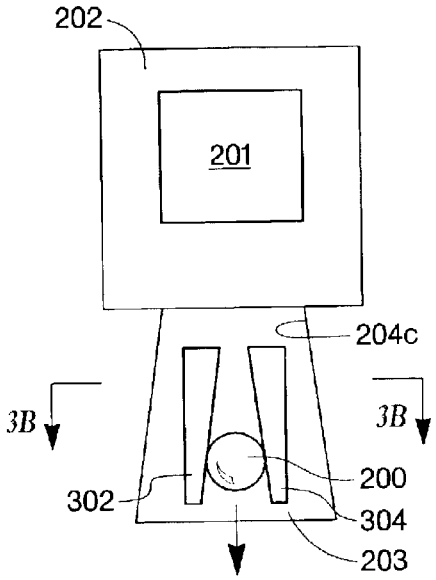
FIGS. 3A and 3B, and 4A and 4B illustrate plan views and elevation views of respective lower barrier feature embodiments.

In the plan view embodiment of FIG. 3A, there are two barrier features 302, and 304. In this embodiment, the barrier features have a substantially trapezoidal shape along the fluid channel. In one embodiment, the barrier feature tapers away from the chamber, such that the base of the trapezoid is nearest the firing chamber. These barrier features each have a length in the range of 5 to 30 microns, and a width in the range of about 0 to 10 microns. I In this embodiment, a distance between the barrier features 302, 304 and side walls 204*c* of the fluid channel converge towards the chamber. Further, in this embodiment shown, the side walls 204*c* generally converge towards the chamber. In the embodiment shown, the fluid channel 203 tapers in toward the firing chamber, such that the fluid channel cross-sectional area increases moving away from the chamber 202. As shown in the embodiment of FIG. 3A, a bubble 200 moves with the tapering barrier features away from the firing chamber until the bubble is no longer larger than the distance in between the barrier features. In this embodiment, the bubble 200 is larger in diameter than the distance in between adjacent barrier features (and/or the distance between the barrier feature and the side walls 204*c*). Generally, the maximum bubble size depends on the thicknesses used and the geometry detail. In one embodiment, surface tension will cause a bubble to try to be a perfect sphere. If that sphere is constrained, the bubble will try to move to a place where it can be a sphere again.

Figure 3B:
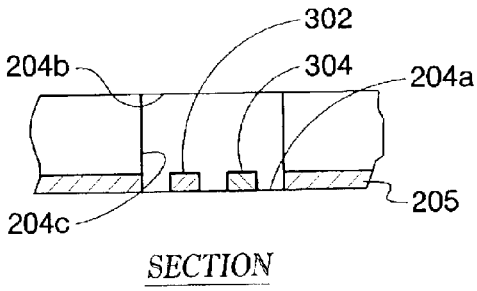

FIG. 3B is a cross-sectional view of the fluid channel through line 3B—3B in FIG. 3A. In this embodiment shown, the barrier features 302 and 304 are substantially the same height. The barrier features 302, 304 protrude from the floor (or bottom surface) 204*a* of the fluid channel 203. In this embodiment, the features 302, 304 correspond to and are substantially the same height as the layer 205. In one embodiment, the thickness (or height) of the primer layer and the barrier features is about 2 to 6 microns, preferably about 6 microns. In one embodiment, the barrier features 302 and 304 are formed of the same materials as and with the same process as the first layer 205.

An area that is open to flow includes the space within the fluid channel other than the barrier features. In this embodiment shown, the percentage of fluid channel that is open to flow is about 90%, assuming no bubbles or particles. In one embodiment, the embodiment of FIGS. 3A and 3B is bubble tolerant, but not particle tolerant.

Figure 4A:
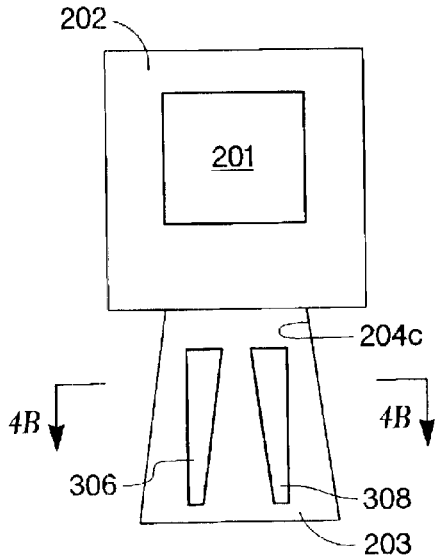

In the plan view embodiment of FIG. 4A, there are two barrier features 306, and 308. In this embodiment the barrier features have a substantially trapezoidal shape along the fluid channel 203. In one embodiment, the barrier features taper away from the chamber, similar to the embodiment of FIG. 3A. These barrier features each have a length and a width comparable to those of the embodiment described above. The barrier features 306 and 308 are substantially the same size in plan view as the barrier features 302 and 304. In one embodiment, the barrier features 302 and 304 are formed of the same materials as and with the same process as the first layer 205.

In this embodiment shown, the side walls 204*c* generally converge towards the chamber. Further, in this embodiment, a distance between the barrier features 306, 308 and side walls 204*c* of the fluid channel generally converge towards the chamber.

Figure 4B:
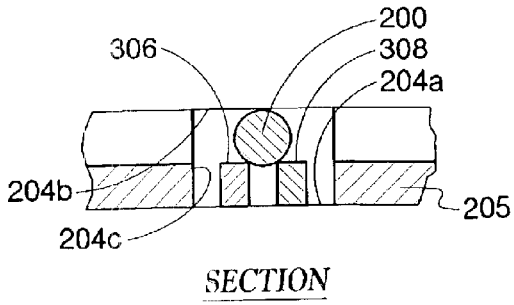

FIG. 4B is a cross-sectional view of the line 4B—4B in FIG. 4A. In this embodiment, the barrier features 306 and 308 are substantially the same height, and correspond to and are substantially the same height as the layer 205. The barrier features protrude from the floor 204*a* of the fluid channel 203. FIG. 4B illustrates a primer layer 205 that is thicker than the primer layer shown in FIG. 3B. In one embodiment, the thickness of the primer layer and the barrier features is about 2 to 6 microns, preferably 6 microns.

In the embodiment shown, a bubble or particle 200 lies between the barrier features 306, 308 and a ceiling 204*b* of the fluid channel. The largest bubble in this embodiment has a diameter that is larger than the distance between the two barrier features. This bubble is positioned against the ceiling 204*b* of the fluid channel, generally above and in between the barrier features 306 and 308. In one embodiment, the size of the maximum bubble 200 may range up to about 6 microns in diameter depending upon the size of the barrier features and fluid channel. In this embodiment, the percentage of fluid channel that is open to flow (assuming no bubbles or particles therein) is about 60 to 70%.

Methods of Forming Floor and Ceiling Barrier Feature Embodiments

Figure 5A:
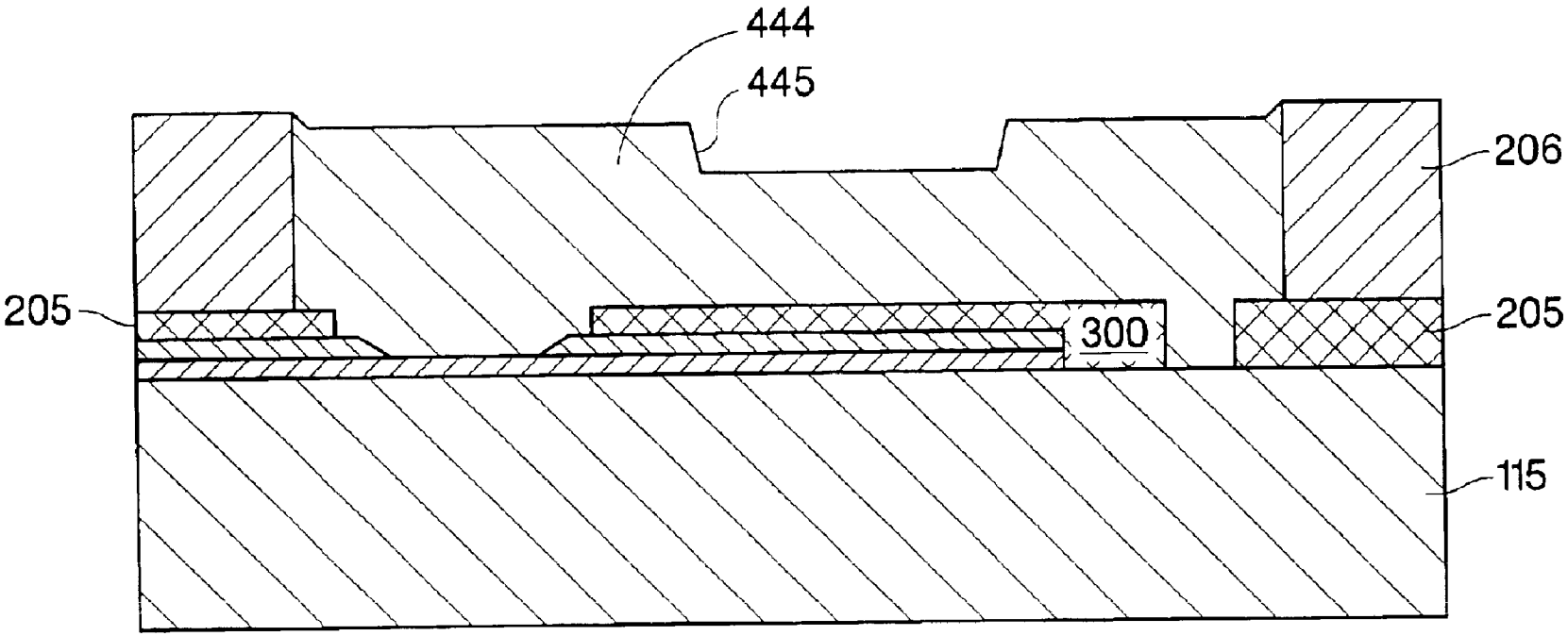
FIGS. 5A and 5B illustrate steps in forming a cross-sectional view of another embodiment of a fluid ejection device taken through section 2A—2A of FIG. 1.
Figure 5B:
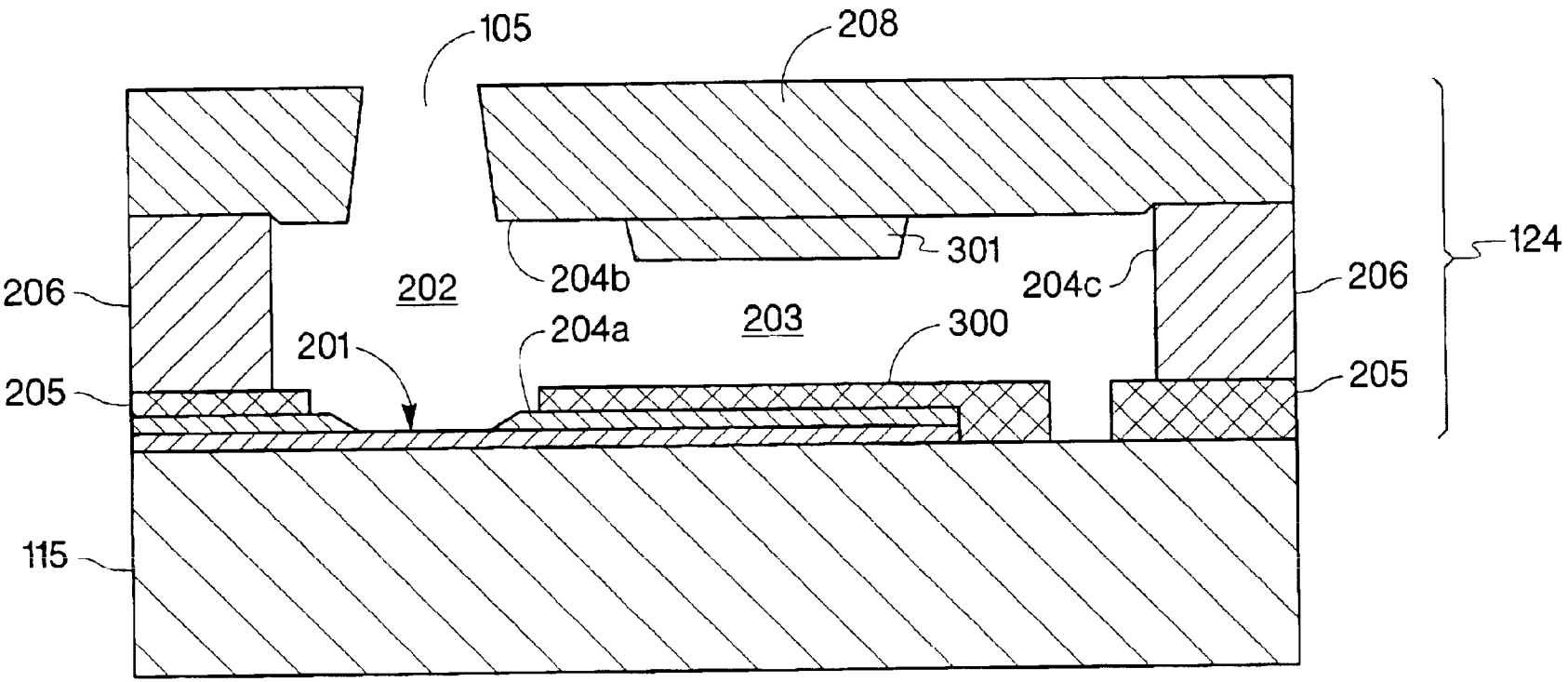

FIGS. 5A and 5B illustrate steps in forming a cross-sectional view of another embodiment of a fluid ejection device taken through section 2A—2A of FIG. 1. In this particular embodiment, the top layer 124 comprises at least three (3) layers: 205, 206, and 208. These layers 205, 206, 208 form the chamber 202, the channel 203, the barrier feature(s), and the nozzle 105. The first (or primer or bottom) layer 205 is similar to the primer layer described above and defines the floor barrier feature 300, in one embodiment. The middle or chamber layer 206 is formed over layer 205 and forms the side walls of the chamber 202 and channel 203. The top hat layer or nozzle layer 208 is formed over layer 206 and in one embodiment, forms a ceiling barrier feature 301, the ceiling of the fluid channel 203, as well as the nozzle 105 over the chamber 202. In one embodiment, the ceiling barrier feature 301 is one of a stalactite, and a short platform. In another embodiment, the ceiling barrier feature 301 is a bubble direction disrupter.

Figure 5C:
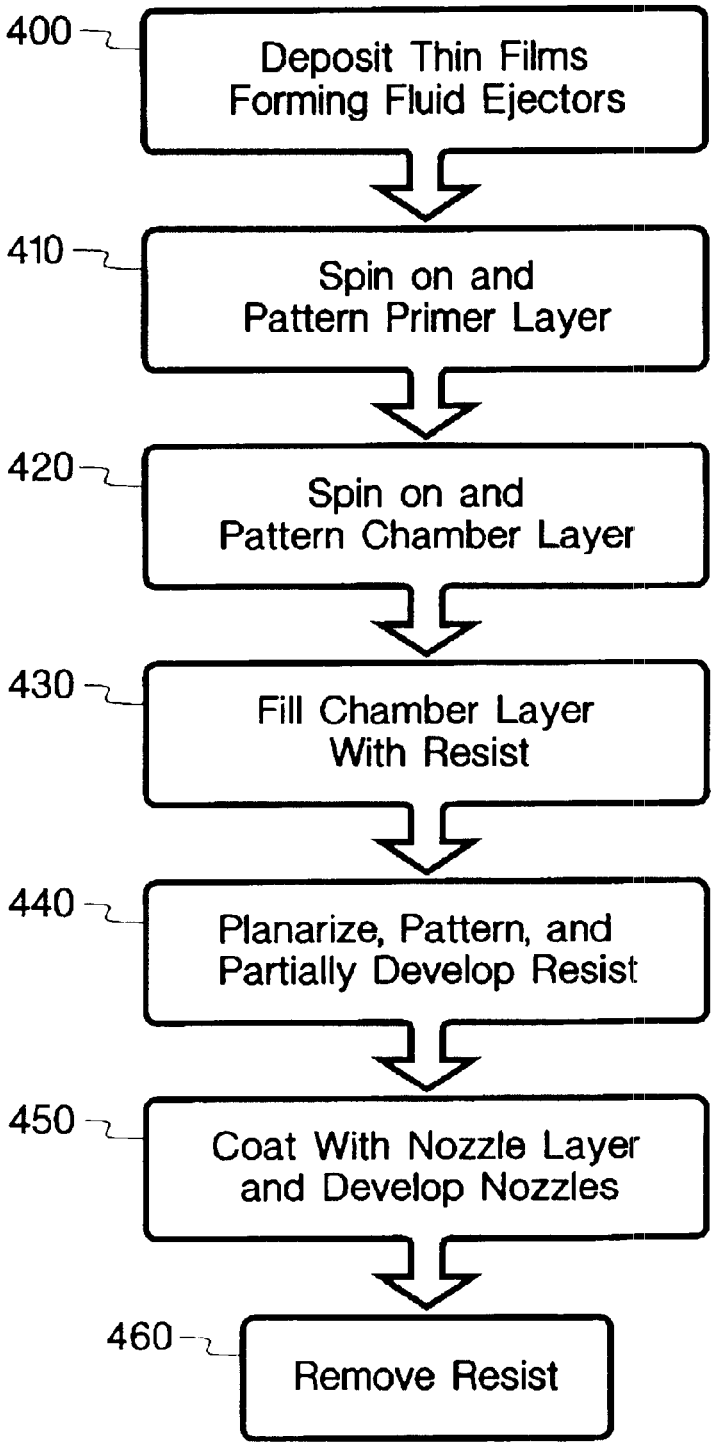
FIG. 5C illustrates an embodiment of a process flow chart for forming FIG. 5B.

FIG. 5C illustrates an embodiment of a process flow chart for forming the cross-sections shown in FIGS. 5A and 5B. The embodiment of the method illustrated in FIGS. 5A and 5B, and described in FIG. 5C, can be characterized as a lost wax method. In this lost wax method, generally after the layers 205 and 206 are formed, a photoresist material is formed, patterned and developed within the layers 205 and 206. The additional topcoat layer is deposited over the photoresist material, before the photoresist material is removed in this embodiment.

More particularly, steps 400 through steps 440 are illustrated in the embodiment of FIG. 5A. Steps 450 and 460 are illustrated in the embodiment of FIG. 5B. In the embodiment described at step 400, thin films forming the fluid ejectors are deposited over the substrate 115. In the embodiment described at step 410, the primer layer 205 is spun over the thin films, and patterned to form the barrier feature(s) 300. In the embodiment shown in FIG. 5A and described at step 420, the chamber layer 206 is spun over the primer layer and patterned to form the inner or side walls of the firing chamber and fluid channel. In the embodiment described at step 430, material 444, such as photoresist, is deposited within the inner walls of the firing chamber and fluid channel. In the embodiment described at step 440, the photoresist 444 is planarized with CMP, and then patterned and partially developed to form a trench 445 in the photoresist 444. In one embodiment, after planarizing the resist with CMP, the resist is uncured enough that it can still be imaged. In this embodiment, a trench is patterned in the resist and exposed to form the trench. In an additional embodiment, the photoresist is a positive photoresist, wherein the positive photoresist is partially exposed, and a fraction of the full thickness of the resist is removed to define the trench. In another embodiment, the positive photoresist is fully exposed, and the develop is timed to remove a part of the full thickness, such that the trench 445 is formed within the photoresist. In yet another embodiment, the material 444 can include any sacrificial material. In this embodiment, after planarizing the sacrificial material with CMP, the sacrificial material is unimagable. In this embodiment, a mask is positioned over the sacrificial material 444, and exposed and patterned. In this embodiment, the trench 445 is formed by a wet etch, a dry etch, or ash out.

In the embodiment described at step 450 of FIG. 5C and shown in FIG. 5B, the layer 206 and the photoresist 444, including the trench 445, is coated with a material forming the nozzle layer 208. In this embodiment, the nozzle layer material in the trench 445 forms the ceiling barrier features 301, as described in more detail below. Further at step 450, the nozzles 105 are developed in the nozzle layer material. In the embodiment described at step 460, the photoresist 444 is removed, such that layers 205, 206 and 208 define the fluid channel, firing chamber, and barrier feature(s).

In one embodiment, layers 205, 206, and 208 are formed of different materials. In this embodiment, layers 205, 206, and 208 are formed of the same material. In this embodiment, layer 205 and floor barrier feature 300 have a thickness of about 2 to 6 microns, preferably 6 microns. The layer 206 has a height in the range of about 15 to 20 microns. The layer 208 has a height in the range of about 5 to 15 microns. The ceiling barrier feature 301 has a thickness of about 2 to 6 microns, preferably 6 microns.

Floor and Ceiling Barrier Feature Embodiments

Embodiments of FIGS. 6A, 6B, 7A, 7B, 8A, 8B illustrate multiple barrier features, wherein there is at least one ceiling barrier feature 301 or floor barrier feature 300 formed as described herein. In these embodiments, the distance in between the barrier features and the side walls 204*c* of the channel 203 generally tapers toward the chamber. In these embodiment shown, the side walls 204*c* of the fluid channel generally converge towards the chamber. Further, in these embodiments, a distance between the outer barrier features and side walls 204*c* of the fluid channel generally converge towards the chamber. In this manner, the bubble moves away from the chamber, toward the shelf, as the bubble increases in size.

Figure 6A:
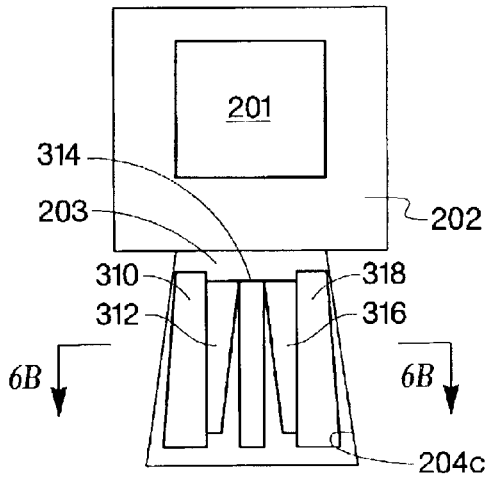
FIGS. 6A and 6B, 7A and 7B, 8A and 8B, 9A and 9B, 10A and 10B, 11A and 11B illustrate plan views and elevation views of respective upper and lower barrier feature embodiments.

In the plan view embodiment of FIG. 6A, there are five barrier features 310, 312, 314, 316, and 318. In this embodiment, the barrier features 310, 312, 316, and 318 each have a substantially trapezoidal shape along the fluid channel. The barrier feature 314 has a substantially rectangular shape along the fluid channel in this embodiment. In this embodiment, these barrier features each have a length and a width comparable to those of previous embodiments. In one embodiment, the floor barrier features 312 and 316 are formed of the same materials and with the same process as the first layer 205.

In this embodiment, the floor barrier features 312 and 316 taper away from the chamber, such that bases of the trapezoid are near the firing chamber. Barrier features 310 and 318 taper toward the chamber, such that bases of these trapezoids are near the entrance to the fluid channel, in this embodiment.

Figure 6B:
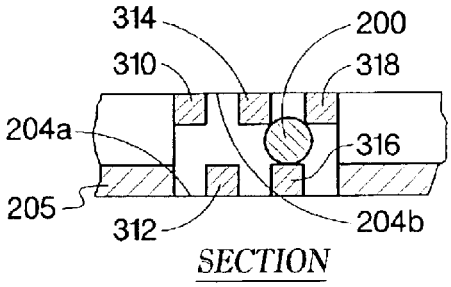

FIG. 6B is a cross-sectional view of the line 6B—6B in FIG. 6A. The floor barrier features 312 and 316 in this embodiment protrude from the floor 204*a* of the fluid channel. In this embodiment, the barrier features 312 and 316 are substantially the same height, and correspond to and are substantially the same height as the layer 205. FIG. 6B illustrates a primer layer 205 that is about the same thickness as that of the primer layer 205 shown in FIG. 3B. In one embodiment, the thickness of the primer layer and the barrier features is about 2 to 6 microns, similar to that of FIG. 3B. In one embodiment, the barrier features 312 and 316 are formed of the same materials as and with the same process as the first layer 205.

In this embodiment, ceiling barrier features 310, 314, and 318 protrude from the ceiling 204*b* of the fluid channel. These barrier features 310, 314, and 318 are substantially the same height. In one embodiment, the thickness or height of these barrier features 310, 314, and 318 are about 2 to 6 microns, preferably 6 microns. In the embodiment shown, the height of the floor barrier features together with a height of the ceiling barrier features is less than the height of the fluid channel. In this embodiment, the channel height is greater than the sum of the heights of the ceiling and floor barrier features, such that there is a height of empty channel space between the ceiling and floor barrier features.

An area that is open to flow includes the space within the fluid channel other than the barrier features. In this embodiment, the percentage of fluid channel that is open to flow (assuming no bubbles or particles) is about 50%.

In one embodiment, a bubble or particle 200 lies between the floor barrier features 312, 316 and ceiling barrier features 310, 314, 318. The diameter of the largest bubble 200 in this embodiment is slightly larger than the height of the empty channel space in the embodiment shown. This largest bubble 200 is positioned between a floor barrier feature and adjacent ceiling barrier features, or in between a ceiling barrier feature and adjacent floor barrier features. In one embodiment, the maximum bubble size is greater than the channel height minus the sum of the thicknesses of the ceiling and floor barrier features. In one embodiment, the size of the maximum bubble 200 may range up to about 8 microns in diameter.

Figure 7A:
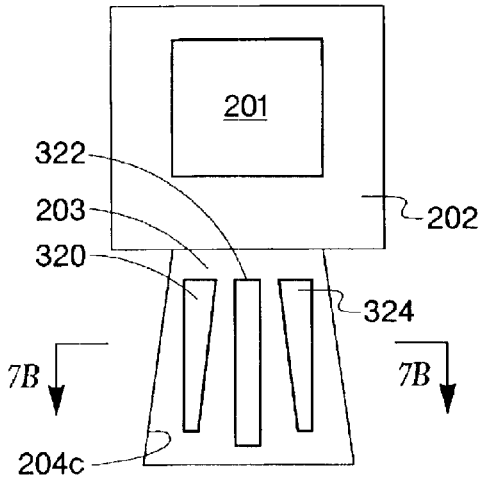

In the plan view embodiment of FIG. 7A, there are three barrier features 320, 322 and 324. In this embodiment, the end barrier features 320 and 324 each have a substantially trapezoidal shape along the fluid channel. The barrier feature 322 has a substantially rectangular shape along the fluid channel in this embodiment. In this embodiment, the barrier features 320 and 324 taper away from the chamber, such that bases of the trapezoid are near the firing chamber. These barrier features each have a length and a width comparable to those of other embodiments described above.

Figure 7B:
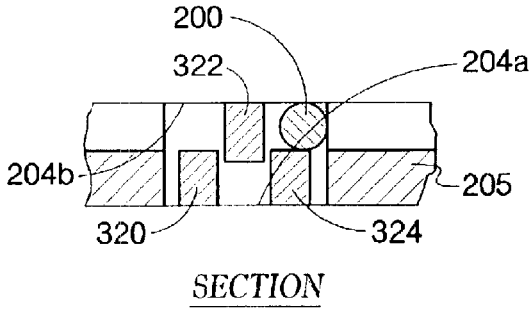

FIG. 7B is a cross-sectional view of the line 7B—7B in FIG. 7A. The floor barrier features 320 and 324 in this embodiment protrude from the floor 204*a* of the fluid channel. In this embodiment, the barrier features 320 and 324 are substantially the same height, and correspond to and are substantially the same height as the layer 205. FIG. 7B illustrates the primer layer 205 that is about the same thickness as that of the primer layer 205 shown in FIG. 4B. In one embodiment, the barrier features 320 and 324 are formed of the same materials as and with the same process as the first layer 205.

In this embodiment, ceiling barrier feature 322 protrudes from the ceiling 204*b* of the fluid channel. In one embodiment, the thickness or height of barrier feature 322 is about 2 to 6 microns. In this embodiment, the channel height is less than the sum of the heights or thicknesses of the ceiling and floor barrier features, such that the ceiling and floor barrier features overlap. The height of the first barrier feature together with a height of the second barrier feature is greater than the height of the fluid channel.

In this embodiment, the percentage of fluid channel that is open to flow (assuming no bubbles or particles) is about 40%. In this embodiment, the bubble or particle 200 lies between the barrier features and the ceiling and side walls of the fluid channel. In the embodiment shown, the maximum bubble is the difference between the barrier feature height, and the ceiling or the floor of the fluid channel. In one embodiment, the size of the maximum bubble 200 may range from about 8 microns in diameter.

Figure 8A:
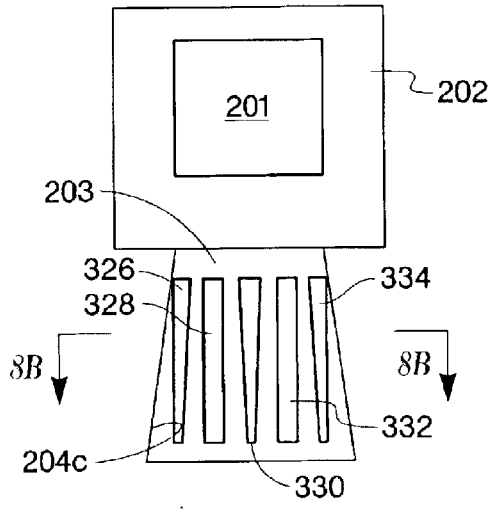

In the plan view embodiment of FIG. 8A, there are five barrier features 326, 328, 330, 332, and 334. In this embodiment, the end barrier features 326, and 334 each have a substantially trapezoidal shape along the fluid channel. The barrier features 328, and 332 each have a substantially rectangular shape along the fluid channel in this embodiment. The middle barrier feature 330 has a substantially triangular shape along the fluid channel. In this embodiment, the barrier features 326, 330, and 334 taper away from the chamber, such that bases of the trapezoid are near the firing chamber.

These barrier features each have a length and a width comparable to the range in previous embodiments. These barrier features have a smaller width than the barrier features of the embodiment of FIG. 6A.

Figure 8B:
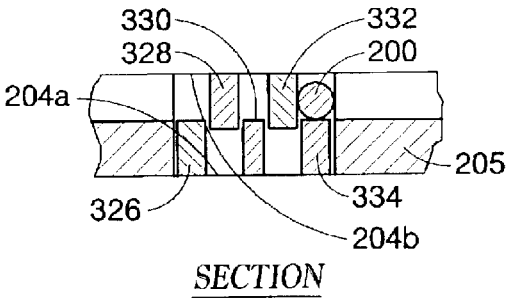

FIG. 8B is a cross-sectional view of the line 8B—8B in FIG. 8A. The floor barrier features 326, 330, and 334 in this embodiment protrude from the floor 204*a* of the fluid channel. In this embodiment, the barrier features 326, 330, and 334 are substantially the same height, and correspond to and are substantially the same height as the layer 205. FIG. 8B illustrates the primer layer 205 that is about the same thickness as that of the primer layer 205 shown in FIG. 4B. In one embodiment, the thickness of the primer layer and these barrier features is about 2 to 6 microns, preferably 6 microns. In one embodiment, the barrier features 326, 330, 334 are formed of the same materials as and with the same process as the first layer 205.

In this embodiment, ceiling barrier features 328 and 332 protrude from the ceiling 204*b* of the fluid channel. These barrier features 328 and 332 are substantially the same height. In one embodiment, the thickness or height of these barrier features 328 and 332 are about 2 to 6 microns, preferably 6 microns. In this embodiment, the channel height is less than the sum of the heights or thicknesses of the ceiling and floor barrier features, such that the ceiling and floor barrier features overlap.

An area that is open to flow includes the space within the fluid channel other than the barrier features. In this embodiment, the percentage of fluid channel that is open to flow (assuming no bubbles or particles) is about 40%.

In this embodiment, the bubble or particle 200 lies between the barrier features and the ceiling and side walls of the fluid channel. In the embodiment shown, the maximum bubble is the difference between the barrier feature height, and the ceiling or the floor of the fluid channel. The diameter of the largest bubble 200 in this embodiment is substantially the distance between adjacent barrier features, or the distance between the barrier feature and the top layer. In one embodiment, the size of the maximum bubble 200 may be up to about 5 microns in diameter.

Figure 9A:
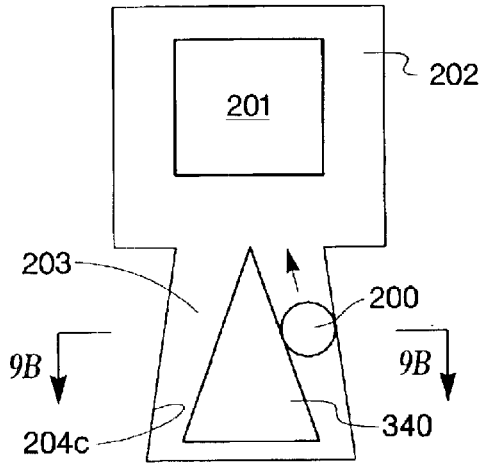
Figure 10A:
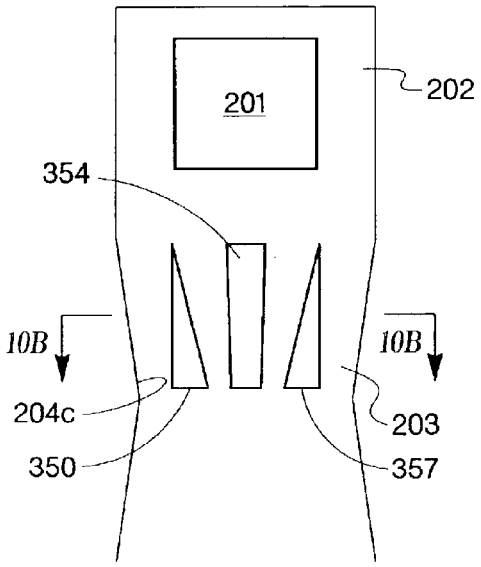
Figure 11A:
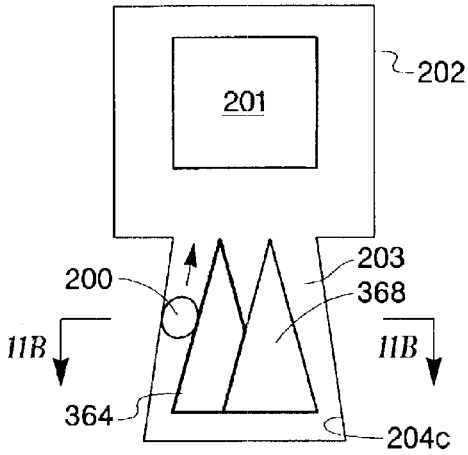

Barrier features in these embodiments of the present invention can be convergent relative to the firing chamber to move the bubble away from the chamber as shown and described in FIGS. 3A, 3B, 4A, 6A, 7A, 8A, or divergent to move the bubble toward the chamber as shown in FIGS. 9A, 10A, 11A and described below.

Reverse Taper Barrier Feature Embodiments

Embodiments of FIGS. 9A, 9B, 10A, 10B, 11A, 11B illustrate reverse taper barrier features in a channel. In one embodiment, the open flow area of the channel (between barrier features and side walls 204*c* of the channel) diverges moving toward the chamber, such that a bubble moves toward the chamber as the bubble increases in size.

In the plan view embodiment of FIG. 9A, there is a triangular shaped barrier feature 340 along the fluid channel 203. The barrier feature 340 comes to a point in an end of the fluid channel which is adjacent the firing chamber 202. The barrier feature 340 has a base in an end of the fluid channel which is adjacent the entrance of the fluid channel. In this embodiment, barrier feature 340 has a length comparable to those of the embodiments described above. In one embodiment the base has a width of about 50% to 80% that of the width of the fluid channel. In this embodiment shown, the side walls 204*c* generally converge towards the chamber, yet the distance between the barrier feature 340 and the side walls 204*c* of the fluid channel diverge towards the chamber, such that bubble 200 moves toward the chamber. In one embodiment, the barrier feature 340 is formed of the same materials as and with the same process as the first layer 205.

Figure 9B:
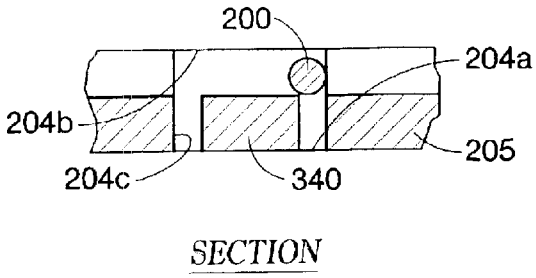

FIG. 9B is a cross-sectional view of the line 9B—9B in FIG. 9A. The barrier feature 340 protrudes from the floor 204*a* of the fluid channel 203. In this embodiment, the floor barrier feature 340 corresponds to and is substantially the same height as the layer 205. In one embodiment, the thickness of the primer layer and the barrier features is about 2 to 6 microns, preferably 6 microns.

In the embodiment shown, the bubble or particle 200 lies between the barrier feature 340 and the ceiling 204*b* of the fluid channel. The largest bubble in this embodiment has a diameter that is larger than the distance between a top surface of the barrier feature and the ceiling. In one embodiment, the size of the maximum bubble 200 may range up to about 6 microns in diameter depending upon the size of the barrier feature and fluid channel. In this embodiment, the percentage of fluid channel that is open to flow (assuming no bubbles or particles therein) is about 60 to 70%.

In the plan view embodiment of FIG. 10A, there are three barrier features along the fluid channel 203: triangular shaped floor barrier features 350 and 357, and ceiling barrier feature 354. In this embodiment, the barrier features 350 and 357 come to a point in an end of the fluid channel which is adjacent the firing chamber 202. The barrier features 350 and 357 each have a base in an end of the fluid channel which is adjacent the entrance of the fluid channel, in this embodiment. In this embodiment, barrier features 350, 354, and 357 have a width and a length comparable to those of the embodiments described above.

In this embodiment shown, the ceiling barrier feature 354 is positioned in between features 350 and 357. The ceiling barrier feature 354 is generally trapezoidal, wherein the base of the trapezoid is near the end of the fluid channel which is adjacent the firing chamber, in this embodiment. In other embodiments, the base of the trapezoid is adjacent the fluid channel entrance, or the barrier feature 354 is substantially rectangular shaped.

In this embodiment shown, the side walls 204*c* of the fluid channel generally diverge towards the chamber. Further in this embodiment, the distance between the barrier features 350 and 357, and their respective side walls 204*c* diverge towards the chamber, such that bubble 200 moves toward the chamber. Also in this embodiment, the distance between the barrier feature 354, and the barrier features 350 and 357 diverges towards the chamber, such that bubble 200 moves toward the chamber.

Figure 10B:
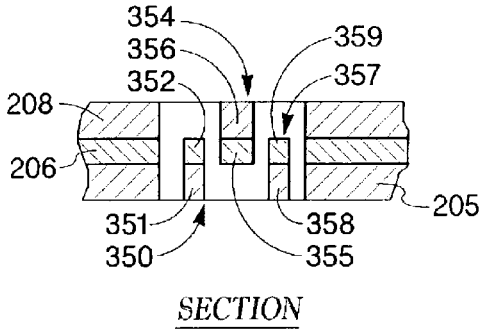

FIG. 10B is a cross-sectional view of the line 10B—10B in FIG. 10A. The barrier features 350 and 357 protrude from the floor 204*a* of the fluid channel 203. In this embodiment, the floor barrier features 350, 357 have a first portion 351, 358, respectively, and a second portion 352, 359, respectively. The first portions 351 and 358 of the floor barrier features correspond to and are substantially the same height as the primer layer 205, and are formed in the same process as the primer layer in this embodiment. The second portions 352, 359 of the floor barrier features are formed over the first portions 351, 358 in this embodiment. Further, the second portions 352, 359 of the floor barrier features correspond to and are formed in the same process as the layer 206, as described above with respect to FIGS. 5A and 5B. In one embodiment, the portions 351, 352, and 355, 356, and 358, 359, are respectively integral barrier features 350, 354, 357.

The ceiling barrier feature 354 has a first portion 356 and a second portion 355, in the embodiment shown in FIG. 10B. In one embodiment, the first portion 356 corresponds to and is formed in the same process as the layer 208, as described above. In the embodiment shown, the second portion 355 corresponds to and is formed in the same process as the layer 206, and thus, corresponds to the second portions 352, 359. In one embodiment, the layer 206, with the second portions 352, 355, and 359, are formed with a lost wax process such that the second portion 355 is resting on sacrificial material. After portion 356, with layer 208, is formed and coupled to portion 355, the sacrificial material is removed.

The largest bubble in this embodiment has a diameter that is larger than the distance between an exposed surface of the barrier feature and either the ceiling, floor, or side walls of the channel. In one embodiment, the size of the maximum bubble 200 may range up to about 6 microns in diameter depending upon the size of the barrier feature and fluid channel. In this embodiment, the percentage of fluid channel that is open to flow (assuming no bubbles or particles therein) is about 40%.

Figure 11B:
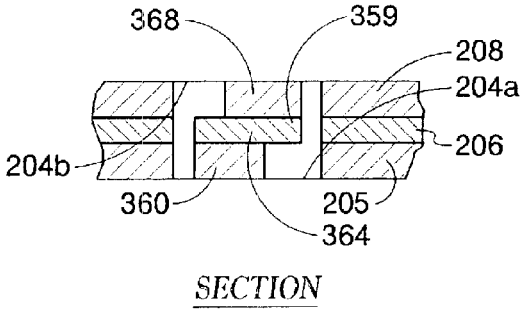

In the embodiment shown in FIGS. 11A and 11B, there are three substantially triangular shaped barrier features 360, 364, and 368 along the fluid channel 203. In this embodiment, these barrier features come to points in an end of the fluid channel which is adjacent the firing chamber 202. These barrier features each have a base in an end of the fluid channel which is adjacent the entrance of the fluid channel, in this embodiment. As shown in this embodiment, the bases of the features are aligned and co-planar. In this embodiment, barrier features 360, 364, and 368 have a width and a length comparable to those of the embodiments described above.

In this embodiment shown, the side walls 204*c* of the fluid channel generally converge towards the chamber. Further in this embodiment, the distance between the barrier features 360, 364, and 368, and their respective side walls 204*c* diverge towards the chamber, such that bubble 200 moves toward the chamber.

FIG. 11B is a cross-sectional view of the line 11B—11B in FIG. 11A. In the embodiment shown, the barrier feature 360 is formed over the bottom 204*a* of the fluid channel 203 with the primer layer 205 and corresponds to the primer layer 205. In this embodiment, the barrier feature 364 is formed over the feature 360 with the layer 206 and corresponds to layer 206. The barrier feature 368 is formed over the feature 364 with the layer 208 and corresponds to layer 208 in this embodiment. The barrier feature 368 is coupled with the ceiling 204*b* of the fluid channel.

The barrier feature 364 is wider than the barrier features 360 and 368, in the embodiment shown. The barrier features 360 and 368 have about the same width, in this embodiment. As shown in this embodiment, at least two edges of the barrier feature 364 are aligned with feature 360 and with feature 368, such that these respective edges are co-planar. The barrier features 360 and 368 are off-set from each other such that only one edge of the barrier feature 360 and only one edge of the barrier feature 369 (such as the base edges) are aligned, in this embodiment. The feature 360 is closer to one side wall 204*c*, while the feature 368 is closer to the opposite side wall 204*c*, as shown in this embodiment.

In the embodiment shown, each triangular shaped barrier feature 360, 364, and 368 has a center point based on the cross-section shown in FIG. 11B. Because the features 360, 364, and 368 are off-set or staggered relative to each other, the center points of the features are also offset. In one embodiment, the barrier features 360, 364, and 368 are integral.

The largest bubble in this embodiment has a diameter that is larger than the distance between an exposed surface of one of the barrier features and either the ceiling, floor, or side walls of the channel. In one embodiment, the size of the maximum bubble 200 may range up to about 6 microns in diameter depending upon the size of the barrier feature and fluid channel. In this embodiment, the percentage of fluid channel that is open to flow (assuming no bubbles or particles therein) is about 20 to 40%.

In several of the embodiments of the present invention, the barrier feature provides particle tolerance and/or bubble tolerance. The barrier feature in embodiments of the present invention minimizes crosstalk in the fluid channel.

It is therefore to be understood that this invention may be practiced otherwise than as specifically described. For example, the present invention is not limited to thermally actuated fluid ejection devices, but may also include, for example, piezoelectric activated fluid ejection devices, and other mechanically actuated printheads, as well as other fluid ejection devices. Thus, the present embodiments of the invention should be considered in all respects as illustrative and not restrictive, the scope of the invention to be indicated by the appended claims rather than the foregoing description. Where the claims recite "a" or "a first" element of the equivalent thereof, such claims should be understood to include incorporation of one or more such elements, neither requiring nor excluding two or more such elements.

What is claimed is:

1. A fluid ejection device comprising:

a substrate having a first surface with a fluid ejector and a top layer formed thereover, the top layer defining a chamber about the fluid ejector and defining a fluid channel directing fluid from a fluid supply into the chamber; and first and second barrier features positioned within the fluid channel, and each having a height that is less than a height of the fluid channel, wherein the first barrier feature protrudes from a bottom surface of the fluid channel, wherein the second barrier feature protrudes from a ceiling of the fluid channel, wherein the height of the first barrier feature together with a height of the second barrier feature is greater than the height of the fluid channel.

2. The fluid ejection device of claim 1 wherein at least one barrier feature of the first and second barrier features has one of a substantially triangular shape and a substantially trapezoidal shape along the fluid channel.

3. The fluid ejection device of claim 1 wherein at least one of the first and second barrier features is formed of a material that forms the top layer.

4. The fluid ejection device of claim 1 wherein the top layer has a first layer and a second layer, wherein the first layer is formed over the first surface of the substrate, wherein the second layer of the top layer is formed over the first layer, wherein the first layer forms the first barrier feature, wherein the second layer forms the ceiling of the fluid channel.

5. The fluid ejection device of claim 1 wherein at least one of the barrier feature and the fluid channel tapers away from the chamber.

6. The fluid ejection device of claim 1 wherein at least one of the barrier feature and the fluid channel tapers toward the chamber.

7. The fluid ejection device of claim 1 wherein the barrier feature tapers away from the chamber, and the fluid channel tapers toward the chamber.

8. The fluid ejection device of claim 1 wherein the barrier feature is at least one of particle tolerant and bubble tolerant.

9. The fluid ejection device of claim 1 wherein the barrier feature has a substantially triangular shape along the fluid channel.

10. The fluid ejection device of claim 1 wherein the top layer has a first layer over the first surface, a second layer over the first layer, and a third layer over the second layer, wherein the first layer forms a first portion of the first barrier feature, wherein the first, second, and third layers form side walls of the fluid channel.

11. The fluid ejection device of claim 1 wherein the fluid ejector is selected from a group consisting of a resistor, a heating element and a bubble generator.

12. A fluid ejection device comprising:

a substrate having a first surface;

a fluid ejector formed over the first surface;

a top layer formed over the first surface of the substrate, the top layer defining a chamber about the fluid ejector and defining a fluid channel directing fluid from a fluid supply into the chamber; and a first barrier feature positioned within the fluid channel, and having a height that is less than a height of the fluid channel, wherein the top layer has a first layer over the first surface, a second layer over the first layer, and a third layer over the second layer, wherein the first layer forms a first portion of the first barrier feature, wherein the first, second, and third layers form side walls of the fluid channel, wherein the second layer forms a second portion of the first barrier feature over the first portion.

13. The fluid ejection device of claim 12 wherein the height of the first barrier feature together with a height of the second barrier feature is less than the height of the fluid channel.

14. The fluid ejection device of claim 12 wherein the third layer forms a third portion barrier feature over the second portion.

15. The fluid ejection device of claim 14 wherein a center point of the first, second, and third portions of the first barrier feature are off-set relative to each other.

16. The fluid ejection device of claim 14 wherein the second portion is wider than the first and third portions.

17. The fluid ejection device of claim 12 wherein the third layer forms a first portion of a second barrier feature that is coupled to a ceiling of the fluid channel.

18. The fluid ejection device of claim 17 wherein the second layer forms a second portion of the second barrier feature.

19. The fluid ejection device of claim 12 wherein the fluid ejector is selected from a group consisting of a resistor, a heating element and a bubble generator.

20. A method comprising:

defining a firing chamber and a fluid channel with a top layer, wherein the firing chamber surrounds a fluid ejection element formed on a substrate, wherein the fluid channel fluidically couples and provides a fluid path between the firing chamber and fluid from a cartridge; and forming a plurality of barrier features within the fluid channel, wherein at least one of the plurality of barrier features has a height that is less than a height of the fluid channel, wherein a first barrier feature protrudes from a bottom surface of the fluid channel, wherein a second barrier feature protrudes from a ceiling of the fluid channel, wherein the height of the first barrier feature together with a height of the second barrier feature is greater than the height of the fluid channel.

21. A fluid ejection device comprising:

a firing chamber and a fluid channel defined with a top layer supported by a substrate, wherein the firing chamber surrounds a fluid ejection element formed on the substrate, wherein the fluid channel fluidically couples and provides a fluid path between the fluid ejection element of the firing chamber and a fluid cartridge; and means for forming a plurality of bubble tolerant barrier features within the fluid channel, wherein each barrier feature has a height that is less than a height of the fluid channel, wherein a first barrier feature protrudes from a bottom surface of the fluid channel, wherein a second barrier feature protrudes from a ceiling of the fluid channel, wherein the height of the first barrier feature together with a height of the second barrier feature is greater than the height of the fluid channel.

22. The fluid ejection device of claim 21 wherein a distance between the barrier features and side walls of the fluid channel diverge towards the chamber.

23. The fluid ejection device of claim 21 wherein a distance between the barrier features and side walls of the fluid channel converge towards the chamber.

24. A fluid ejection device comprising:

a substrate having a first surface;

a fluid ejector formed over the first surface;

a top layer having an orifice layer and a primer layer, wherein the primer layer is formed over the first surface of the substrate, the top layer defining a chamber about the fluid ejector and defining a fluid channel directing fluid from a fluid supply into the chamber;

a barrier island positioned within the fluid channel and formed with the primer layer; and an orifice through which fluid is ejected from the chamber, wherein the orifice is defined by the orifice layer, wherein the barrier island includes a top portion, a middle portion and a bottom portion, wherein at least two edges of the middle portion are aligned with edges of both the top and bottom portions, respectively, wherein only one edge of the top and bottom portions, respectively, are aligned, wherein at least one of the top portion, the middle portion, and the bottom portion has a height that is less than a height of the fluid channel.

25. The fluid ejection device of claim 24 wherein the fluid ejector is selected from a group consisting of a resistor, a heating element and a bubble generator.

26. A method of forming a fluid ejection device comprising:

defining a firing chamber that surrounds an ejection element on a substrate, wherein the firing chamber is defined by a top layer, defining a fluid channel that fluidically couples to the firing chamber, wherein the fluid channel is defined by the top layer;

defining a barrier island in the fluid channel with a first layer of the top layer; and defining a nozzle, through which fluid is ejected by the ejection element, with a second layer of the top layer, wherein the barrier island includes a top portion, a middle portion and a bottom portion, wherein at least two edges of the middle portion are aligned with edges of both the top and bottom portions, respectively, wherein only one edge of the top and bottom portions, respectively, are aligned, wherein at least one of the top portion, the middle portion, and the bottom portion of the barrier island has a height that is less than a height of the fluid channel.

27. The fluid ejection device of claim 26 wherein the ejection element is selected from a group consisting of a resistor, a heating element and a bubble generator.

* * * * *